United States Patent [19]

Burke

[11] Patent Number: 4,931,104

[45] Date of Patent: Jun. 5, 1990

[54] PROCESS FOR CLEANING POROUS PARTS

[75] Inventor: John M. Burke, Kirtland, Ohio

[73] Assignee: Eaton Corporation, Cleveland, Ohio

[21] Appl. No.: 361,190

[22] Filed: Jun. 5, 1989

[51] Int. Cl.[5] ..... C23G 5/024; B08B 7/04

[52] U.S. Cl. ..... 134/40; 134/21; 134/22.18

[58] Field of Search ..... 134/21, 22.18, 22.19, 134/29, 30, 40

[56] References Cited

U.S. PATENT DOCUMENTS

| | | | |
|---|---|---|---|
| 2,032,174 | 2/1936 | Johnson | 134/40 |
| 2,748,084 | 5/1956 | DeLew | 134/40 |
| 3,375,133 | 3/1968 | Scott | 134/40 |
| 3,560,352 | 2/1971 | Garderen | 134/40 |
| 4,097,306 | 6/1978 | Carman | 134/30 |
| 4,590,100 | 5/1986 | Hearst | 134/29 |
| 4,602,963 | 7/1986 | Piatkowski | 134/40 |
| 4,687,523 | 8/1987 | Hall | 134/30 |
| 4,710,232 | 12/1987 | Tahbaz | 134/40 |
| 4,752,411 | 6/1980 | Melin | 252/174.16 |

*Primary Examiner*—Asok Pal
*Assistant Examiner*—Ourmazd Ojan
*Attorney, Agent, or Firm*—A. E. Chrow

[57] ABSTRACT

A cleaning process is provided that is particularly advantageous for removing oil or oil-like material from porous parts such as porous internal combustion engine components such as valves.

The process utilizes oil solubilizing solvents as well as alkaline soap and water solutions and mixtures of water soluble amines and water or deionized water in conjunction with alternate pressure and vacuum cycling to effect the cleaning.

18 Claims, 1 Drawing Sheet

PROCESS FOR CLEANING POROUS PARTS

INTRODUCTION

This invention relates generally to a process for cleaning porous parts and more particularly to a process for removing oil or oil-like materials from porous parts such as powdered metal or powdered ceramic parts of which but one example for which the process of the invention may be advantageously used is for removing oil from internal combustion engine components made from powdered metal.

BACKGROUND OF THE INVENTION

The use of powdered metals and powdered ceramics for making products such as internal combustion engine components is well known and is growing due to the fact that the powders can be conveniently compressed into a shaped die with binders and other additives well known to those skilled in the art and which then are characteristically sintered in the case of powdered metal and sintered or nitrided and sintered in the case of powdered ceramics by processes well known in the art to produce virtually a finished product requiring minimal finish machining while greatly reducing machining scrap loss.

Such products however characteristically exhibit a certain degree of porosity in which the pores retain oil and oil-like materials used during their manufacture that are difficult and time consuming to remove.

The process of the present invention not only provides a rapid and effective way for removing oil and oil-like materials from porous parts such as powdered metal engine valves and powdered metal or powdered ceramic valves guides and valve seats but also can be tailored to provide a surface on the part that is essentially residue free which greatly enhances the ability to adhere another material to the surface by bonding or welding and the like in the event such is required.

The process of the present invention employs, in part, alkaline soap and water solutions and (when tailored to provide an essentially residue-free surface) predetermined mixtures of deionized water and water soluble amines such as morpholine disclosed in my co-pending application Ser. No. 239,255, titled "Metal Cleaning Process" in which it is disclosed that the use of aqueous amine solutions, such as morpholine and ordinary water solutions, for passivating steel is taught in U.S. Pat. No. 4,590,100 and the use of morpholine for rectifying chlorinated hydrocarbon deposits on copper is disclosed in U.S. Pat. No. 4,080,393, the disclosures of both of which are included herein by reference.

SUMMARY OF THE INVENTION

Accordingly, it is an object of this invention to provide a process for cleaning porous parts.

It is another object of this invention to provide a process enabling rapid and effective removal of oil and oil-like materials from porous parts.

It is still another object of this invention to provide a process for cleaning porous parts that leaves an essentially residue-free surface greatly enhancing the ability to effectively adhere another material thereto.

DESCRIPTION OF SOME PREFERRED EMBODIMENTS

Figure 1:
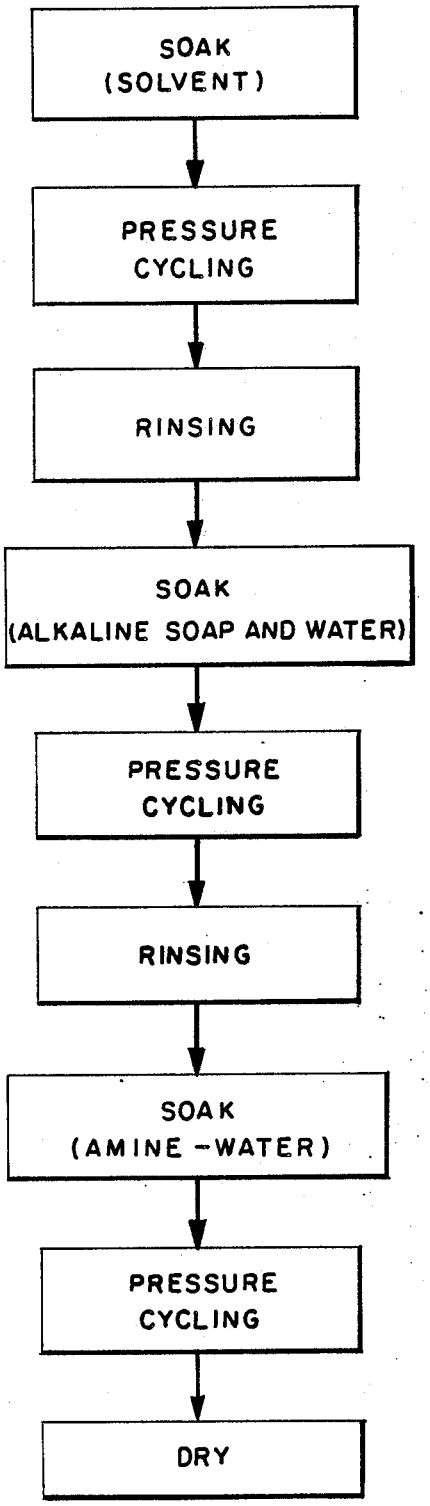
FIG. 1 is a block diagram of a preferred embodiment of the process of this invention.

As shown in FIG. 1, the process of the invention begins by soaking the porous parts in a solvent. The solvent is of the type predetermined suitable to solublize oil and/or other oil-like materials contained in the pores of the porous parts of which it has been found that mineral spirits is an effective solvent able to solubilize a broad spectrum of oils and in particular oils commonly used in the manufacture of powdered metal valves.

The solvent soaking preferably lasts for about two minutes and is preferably done in a suitable pressurizable vessel for the next step is to alternately subject the parts soaking in the solvent to a predetermined pressure (vacuum) below atmospheric pressure and to a predetermined pressure above atmospheric pressure for a preselected number of times. In the case of cleaning powdered metal engine valves, it is preferred that the pressure below atmospheric (vacuum) be about 25.0 inches of mercury that is sustained for about two minutes followed by pressurization at a pressure of about 40 inches of mercury that is sustained for about two minutes and then followed again by the above described vacuum sustained for about two minutes.

It is preferred that the solvent soaking and solvent pressure cycling step be conducted at ambient temperatures.

The parts are then removed from the solvent and rinsed with water which may be deionized water but is preferably ordinary tap water that is preferably heated for which a temperature of about 140° F. has been found to provide effective rinsing and for which in the case of powdered metal valves, a rinsing time of about two minutes has been found to be effective.

The parts are next soaked in an alkaline soap and water solution having a predetermined alkalinity which, in the case of powdered metal valves, preferably is heated to a temperature of about 160° F. It has been found that soaking time of about two minutes in the heated solution is effective for cleaning powdered metal valves.

An alkaline soap found particularly effective for use in the process of the invention is sold under the trademark ISW-29 by Dubois Chemical Company. Although the water component of the solutions may be deionized water, it is preferably ordinary tap water and a preferred solution for cleaning powdered metal valves is where the Dubois ISW-29 alkaline soap comprises from about 3% to about 5% by volume of the total volume of solution used.

As in the case of the solvent previously described, the porous parts are preferably soaked in the solution in a pressurizable vessel which is operable to alternately subject the parts soaking in the solution to a predetermined pressure (vacuum) below atmospheric pressure and to a predetermined pressure above atmospheric pressure for a prescribed number of times. In the case of the powdered metal valves, it has been found that three vacuum cycles at vacuum of about 25 inches of mercury sustained for about two minutes each interspersed by two pressure cycles at about 40 inches of mercury sustained for about two minutes each is highly effective, particularly when the solutions is in a heated condition such as at about 160° F.

The parts are then removed from the alkaline soap and water solution and rinsed with water, preferably tap water, that preferably is heated to about 140° F. as previously described.

The parts are next soaked in a predetermined mixture of water and a water soluble amine such as ethanolamine or diethanolamine or triethanolamine which mixtures are characteristically less than about 50% and more commonly less than about 20% and characteristically range from about 0.1% to about 10% by weight of the water soluble amine. However, in order to provide an essentially residue-free surface, it has been discovered that the water soluble amine should have a vapor pressure of at least 10% of the vapor pressure of water at 20° C. which in fact is the case for morpholine with the preferred mixtures being from about 0.1% to about 1.0% by weight morpholine to the total weight of the morpholine water mixture.

A soaking time of about 2 minutes with the mixture at ambient temperature has been found to be effective when cleaning engine valves by the process of the invention. The soaking is preferably conducted in a pressurizable vessel for the parts are again alternatively subjected, while in the mixture, to a predetermined pressure (vacuum) below atmospheric pressure and to a predetermined pressure above atmospheric pressure for a preselected number of times which, in the case of cleaning powdered metal valves has been found to be the solvent pressure cycling schedule previously described.

Although tap water may be used for the water soluble amine mixture , it has been found that deionized water, preferably deionized water having an electrical volume resistivity of from about $10^5$ to about $10^6$ ohm cm in combination with morpholine as the water soluble amine is most effective in providing essentially residue-free surfaces. Thus, a mixture preferably comprising from about 0.1% to about 1.0% and more preferably about 0.5% by weight morpholine to the total weight of the morpholine deionized water mixture has been found to be highly advantageous for use in the process of the invention.

The parts are then removed from the water-water soluble amine mixture and dryed, preferably by exposing the parts to air which, when heated to a temperature of about 220° F., has been found to effectively dry powdered metal engine valves cleaned by the process of the invention in about two hours.

By way of example, the five (5) powdered metal engine parts shown in Table I were individually weighed (called WB) and then dipped in 120 S.U.S. turbine oil at a temperature of 140° F. for one hour and again individually weighed (called WA) and then cleaned by the process of the invention using mineral spirits as the solvent and rinse water heated to a temperature of about 140° F. and dried for about two hours in air heated to a temperature of about 220° F. and finally again individually weighed (called WC).

TABLE I

| | (Weight in grams) | | | |
|---|---|---|---|---|
| Valve No. | WB | WA | WC | WC − WB |
| 1 | 52.5895 | 52.8529 | 52.6575 | 0.0680 |
| 2 | 52.6103 | 52.8907 | 52.6742 | 0.0639 |
| 3 | 52.3724 | 52.6746 | 52.4406 | 0.0682 |
| 4 | 52.5332 | 52.8352 | 52.6074 | 0.0742 |
| 5 | 52.5389 | 52.8391 | 52.6108 | 0.0719 |

The effectiveness of the cleaning process of the invention is illustrated in TABLE I by the extremely small weight difference (WC-WB) which is the respective weight of the valves before exposure to the oil (WB) and after being cleaned (WC) by the process of the invention.

By way of a first comparative example, 15 powdered metal engine parts were respectively weighed; dipped in the above described oil; and again weighed; and then cleaned by first washing the valves for 240 minutes in the previously described 5% Dubois ISW-29 alkaline soap and water solution at a temperature of 160° F. and then rinsing in deionized water at ambient temperature for two minutes followed by rinsing in the previously described 0.5% deionized water-morpholine mixture at ambient temperature for about two minutes then dried in air at ambient temperature for 60 minutes. The result, when measured in grams, between their weight before dipping in oil and after cleaning was a weight difference ranging from 0.3647 grams to 0.4111 grams which is about 5 times the weight associated with cleaning by the process of the invention indicating that a considerable amount of oil still remained in the pores of the powdered metal valves.

By way of a second comparative example, another 15 powdered metal parts were cleaned by the process of the first comparative example except that the valves were air dried at ambient temperature for 24 hours rather than 1 hour with the result that the weight difference before dipping in oil and after cleaning ranged from 0.2414 to 0.3730 grams which is about 3½ times the weight difference achieved by the process of the invention.

A third comparative test was undertaken in which two powdered metal parts are dipped in mineral spirits at ambient temperature for 30 minutes and then washed in the 5% Dubois ISW-29 alkaline soap and water solution at 160° F. for 4 minutes followed by rinsing in ambient tap water for 1 minute and then dipping in the previously described 0.5% morpholine-deionized water mixture at 200° F. for 60 minutes followed by rinsing in the second 0.5% morpholine-deionized water mixture at 140° F. for 1 minute followed by drying in 220° F. air for 30 minutes. The result was a weight difference before dipping in oil and after cleaning of 0.1527 grams and 0.1700 grams respectively which is about 1¾ times the weight difference achieved by the process of the invention.

By way of yet further comparative examples, two powdered metal parts were cleaned by the process of the third example described above except that the valves were dipped in the 0.5% morpholine-deionized water mixture for two hours rather than one hour in the first instance and for about four hours in the second instance with the result being a weight difference ranging from 0.1333 grams to 0.1700 grams which is about two times that achieved by the process of the invention.

What is claimed is:

1. A process for removing oil or oil-like material from porous parts, said process comprising the steps of:

(a) soaking the parts in a solvent predetermined suitable for solubilizing the oil or oil-like material;

(b) alternately subjecting the parts soaking in the solvent of step (a) to a predetermined pressure below atmospheric pressure and to a predetermined pressure above atmospheric pressure a preselected number of times;

(c) rinsing the parts of step (b) with water;

(d) soaking the parts of step (c) in an alkaline soap and water solution having a prescribed alkalinity;

(e) alternately subjecting the parts soaking in the solution of step (d) to a pressure less than atmospheric pressure and to a pressure above atmospheric pressure a preselected number of times;

(f) rinsing the parts of step (e) with water;

(g) soaking the parts of step (f) in a predetermined mixture of water and a water soluble amine;

(h) alternately subjecting the parts in the mixture of step (g) to a predetermined pressure below atmospheric pressure and to a predetermined pressure above atmospheric a preselected number of times; and (i) drying the parts of step (h).

2. The process of claim 1 wherein the solvent of step (a) is mineral spirits.

3. The process of claim 1 wherein the water of step (c) is heated water.

4. The process of claim 1 or 3 wherein the water of step (f) is heated water.

5. The process of claim 1 wherein the solution of step (e) is a heated solution.

6. The process of claim 1 wherein the water of step (g) is deionized water.

7. The process of claim 6 wherein the deionized water has an electrical volume resistivity of from about $10^5$ to about $10^6$ ohm cm.

8. The process of claim 1 or 6 wherein the water soluble amine has a vapor pressure of at least about 10% of the vapor pressure of water at 20° C.

9. The process of claim 8 wherein the water soluble amine is morpholine.

10. The process of claim 9 wherein the morpholine comprise from about 0.1% to about 1% by weight of the total weight of the mixture.

11. A process for removing oil or oil-like material from porous parts, said process comprising the steps of:

(a) soaking the parts in a solvent predetermined suitable for solubilizing the oil or oil-like material;

(b) alternately subjecting the parts soaking in the solvent of step (a) to a pressure below atmospheric pressure and to a pressure above atmospheric pressure a preselected number of times;

(c) rinsing the parts of step (b) with heated water;

(d) soaking the parts of step (a) in an alkaline soap and water solution having a prescribed alkalinity;

(e) alternately subjecting the parts soaking in the solution of step (d) to a pressure below atmospheric pressure and to a pressure above atmospheric pressure a preselected number of times;

(f) rinsing the parts of step (e) with heated water;

(g) soaking the parts of step (f) in a predetermined mixture of deionized water and morpholine:

(h) alternately subjecting the parts soaking in the mixture of step (g) to a pressure below atmospheric pressure and to a pressure above atmospheric pressure a preselected number of times; and (i) drying the parts of step (h).

12. The process of claim 11 wherein the solvent of step (a) is mineral spirits.

13. The process of claim 11 wherein the deionized water of step (g) has an electrical volume resistivity of from about $10^5$ to about $10^6$ ohm cm.

14. The process of claim 11 wherein the mixture if step (i) comprises from about 0.1% to about 1% by weight morpholine to the total weight of the mixture.

15. The process of claim 1 or 11 wherein the parts are powdered metal parts.

16. The process of claim 1 or 11 wherein the parts are powdered ceramic parts.

17. The process of claim 1 or 11 wherein the parts are internal combustion engine components.

18. The process of claim 17 where the components are valves.

* * * * *